US011032878B2

(12) United States Patent
Carcano et al.

(10) Patent No.: US 11,032,878 B2
(45) Date of Patent: Jun. 8, 2021

(54) METHOD FOR MANAGING A MICROWAVE HEATING DEVICE AND MICROWAVE HEATING DEVICE

(71) Applicant: ILLINOIS TOOL WORKS INC., Glenview, IL (US)

(72) Inventors: Marco Carcano, Senago (IT); Michele Sclocchi, San Donato Milanese (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 445 days.

(21) Appl. No.: 15/713,861

(22) Filed: Sep. 25, 2017

(65) Prior Publication Data

US 2018/0092165 A1 Mar. 29, 2018

Related U.S. Application Data

(60) Provisional application No. 62/399,601, filed on Sep. 26, 2016.

(51) Int. Cl.

| | |
|---|---|
| ***H05B 6/70*** | (2006.01) |
| ***H05B 6/76*** | (2006.01) |
| ***H05B 6/68*** | (2006.01) |
| ***H05B 6/66*** | (2006.01) |

(Continued)

(52) U.S. Cl.

CPC ..... *H05B 6/686* (2013.01); *H05B 6/6467* (2013.01); *H05B 6/666* (2013.01); *H05B 6/687* (2013.01); *H05B 6/702* (2013.01); *H05B 6/72* (2013.01); *H05B 6/705* (2013.01)

(58) Field of Classification Search

CPC ..... H05B 6/687; H05B 6/6467; H05B 6/666; H05B 6/72; H05B 6/702; H05B 6/686; H05B 6/705

USPC ..... 219/709, 745, 746, 748, 749, 750, 679, 219/678, 690, 695, 696, 686, 716; 73/23.35; 95/82, 87; 422/89

See application file for complete search history.

(56) References Cited

U.S. PATENT DOCUMENTS

| | | | | |
|---|---|---|---|---|
| 4,717,884 | A * | 1/1988 | Mitzlaff | H03F 3/217 330/251 |
| 2010/0176123 | A1* | 7/2010 | Mihara et al. | H05B 6/70 219/746 |
| 2010/0243645 | A1 | 9/2010 | Ishizaki et al. | |

(Continued)

FOREIGN PATENT DOCUMENTS

| | | | |
|---|---|---|---|
| CN | 1504686 | A | 6/2004 |
| CN | 1578862 | A | 2/2005 |

(Continued)

OTHER PUBLICATIONS

International Search Report and Written Opinion of PCT/US2017/053435 dated Apr. 9, 2018, all enclosed pages cited.

*Primary Examiner* — Quang T Van

(74) *Attorney, Agent, or Firm* — Burr & Forman LLP

(57) ABSTRACT

A method for managing a microwave heating device able to operate based on a first signal having a first fundamental harmonic frequency that is within the microwave range, wherein operation of the microwave heating device (1) is interrupted or modified when, inside the microwave heating device (1), the presence of a second signal is detected, the latter having harmonic components which have frequencies that are different from a fundamental harmonic frequency and an intensity higher than a critical reference value.

5 Claims, 2 Drawing Sheets

(51) Int. Cl.
*H05B 6/64* (2006.01)
*H05B 6/72* (2006.01)

(56) References Cited

U.S. PATENT DOCUMENTS

| | | | |
|---|---|---|---|
| 2015/0070029 | A1 | 3/2015 | Libman et al. |
| 2015/0223294 | A1 | 8/2015 | Zickel et al. |

FOREIGN PATENT DOCUMENTS

| | | | |
|---|---|---|---|
| CN | 102474925 | A | 5/2012 |
| EP | 1470280 | A1 | 10/2004 |
| EP | 2418916 | A1 | 2/2012 |
| WO | 2005059230 | A1 | 6/2005 |
| WO | 2010140342 | A1 | 12/2010 |

* cited by examiner

METHOD FOR MANAGING A MICROWAVE HEATING DEVICE AND MICROWAVE HEATING DEVICE

CROSS REFERENCE TO RELATED APPLICATIONS

This application claims priority to U.S. patent application No. 62/399,601 filed Sep. 26, 2016, the entire contents of which are hereby incorporated by reference.

TECHNICAL FIELD

This disclosure relates in general to the sector of microwave heating devices. In particular, this disclosure relates to microwave heating devices in which the generation of microwaves is guaranteed by solid-state generators. Even more precisely, this disclosure relates to microwave devices for heating and cooking food products.

In more detail, this disclosure relates to a method for managing a microwave heating device with the aim of preventing or limiting electric discharges inside the device, and a device able to implement it.

BACKGROUND

The technical solution which forms the subject matter of this disclosure applies in general to any microwave heating device with a solid-state microwave generator. However, preferably, this disclosure relates to the heating of food products.

It is known that a microwave heating device comprises a heating chamber in which a product to be heated can be placed, in which there is one or more radiating portions (or antennae) in use able to emit the microwaves.

The latter are generated by a solid-state signal generator capable of generating sinusoidal signals with a fundamental harmonic frequency in the microwave range. The sinusoidal generator is connected to the radiating portions present by means of a supply circuit that, usually, also comprises one or more power amplifiers (which are also of the solid-state type). In particular, there are prior art solutions with a single power amplifier that supplies all of the radiating portions and other solutions with a plurality of power amplifiers each supplying one or more radiating portions.

The radiating portions may be made in any way: for example, they may be constituted of waveguide antennae, dipole antennae or patch antennae.

The signal generator and the supply circuit can usually be set according to multiple operating configurations, each operating configuration having its own operating fundamental harmonic frequency, as well as any differences in phase and intensity between the signals transmitted to each radiating portion. In fact, by varying the phase and intensity of the different signals emitted in the heating chamber, it is possible to control and distribute the power in the product being heated. In the context of this entire disclosure, the expression operating configuration in general refers to the set of all parameters linked to the emission of the microwaves in the heating chamber at each radiating portion, such as the fundamental frequency, signal amplitude and phase (absolute or relative to a reference phase). In general, although it is even possible that the signals transmitted to each radiating portion also differ as regards the respective fundamental frequency, in the preferred embodiments the operating frequency at every moment is the same for all of the radiating portions, although it may vary over time during the heating cycle.

The active cooking phase of a microwave heating device, like a microwave oven, requires power levels of some hundreds of watts in the chamber, that generate very high peak levels of electrical field.

Consequently, arcing is likely to occur if metal supports are used, such as stainless steel or aluminum trays placed on the sliding support grid made of stainless steel usually present in the oven; and although it could seem strange for physicists, use of metal supports in microwave ovens is normal for cooks who act in the same way with traditional electric ovens and microwaves ovens.

These metal parts (trays and support grids) are not perfectly flat, meaning that there are many points of contact between the bottom side of the tray and the upper side of the grid, randomly distributed. However, at microwave frequencies, each couple of points of contact between two metal parts, together with surrounding air gaps between the same parts, can be described as a resonating circuit, the resonance frequency of which depends upon the distance between the couple of points of contact.

It is then likely to happen that one or more couples of points has a distance equivalent to a multiple of half or a quarter of the fundamental wavelength at the microwave frequency used in the oven. Unluckily, such a situation can be described as an equivalent resonant circuit with a resonant frequency corresponding to the actual microwave frequency.

As known, a resonator involves an air gap and metal parts, resulting in a relatively high Q factor of the equivalent LC circuit. But the Q factor is also the multiplying factor of the peak voltage of the resonating circuit. That means that the higher the Q, the higher the voltage peak inside the resonator for a given excitation energy.

In the case of a metal tray lying above a metal supporting grid, the air gaps between two points of contact can be very thin, resulting in a poor insulation to voltage peaks.

The result of applying high energy inside a heating chamber of a microwave heating device where metal parts are used and kept in contact, is to generate high electrical fields (or differential voltages) between adjacent metal parts, with reduced air gaps, which inevitably leads to arcing phenomena.

Once the arc has been excited in an air channel previously ionized by one or more ignition sparks, the arc absorbs a very high quantity of energy, resulting in serious damage of the metal parts involved in the phenomenon.

These harmful effects could happen in various points of the equipment, not only in the heating chamber, with possible serious damage to the metal tools, to the chamber structure and to the microwave generator.

A situation similar to that of contact between the metal tray and support grid also occurs every time anywhere in the microwave heating device located between the power amplifier and the radiating portions connected to it, small air gaps are created between two metal parts, for example in the case of connectors that are not perfectly secured. In fact, each metal contact zone adjacent to these small air gaps behaves like a resonant circuit, exposing the air gap to the risk of discharges.

Given these problems, the need was felt for technical solutions that are able either, preferably, to prevent the onset of electric arcs, or at least to stop them as they arise, as soon as they appear.

According to known techniques, arcing detection systems in microwave transmission equipment are based on the observation of reflected power wave amplitude variations. The standard operating conditions of the system require a good return loss to the microwave generator output (typically reflected wave amplitude is lower than 10% of the forward wave amplitude, that is VSWR (Voltage Standing Wave Ratio)<1.2:1). The application of a suitable reflected amplitude threshold is then always sufficient to protect against bad load behaviors, usually including arcing phenomenon generated by bad contacts between the output path passive components (for example weak connections along the coaxial output line or between waveguide parts).

By contrast, cooking appliances cannot guarantee a good return loss to the microwave generator, even if there was an advanced control system that maximized the equipment efficiency by maximizing the energy transfer to the food.

In cooking appliances, the reflected wave amplitude is always above 50% of the forward wave amplitude: an efficiency of 90% roughly means 10 dB of return losses, equal to a VSWR of 2:1, corresponding to a reflected wave amplitude of ½ the forward wave amplitude.

This means that it is almost impossible to perform an efficient detection and prevention of an arcing phenomenon in the chamber from the analysis of the reflected wave behavior: the standard heating chamber reflections are always wide and the arcing start is not detectable.

It is worth noting that once the arc path is fully ionized and the arc has been excited, the arc becomes an absorbing load, reducing the amount of reflected wave and becoming even more difficult to be detected and controlled according to known detection solutions.

In this context, there is a real need to provide a new method for managing a microwave heating device that allows prevention of the onset of electric arcs or at least minimizes their duration.

In particular, there is the need to provide a method for managing the microwave heating device that allows detection of either the onset of the electric arc as soon as it appears, or, preferably, localized ionization of the air (which corresponds to the appearance of a random sequence of transitory sparks) which in itself is preliminary to the start of the arc.

There is also the need to provide a microwave heating device that is managed according to that management method, and therefore that is less exposed to the risks linked to electric arcs than the prior art microwave heating devices are.

BRIEF SUMMARY OF SOME EXAMPLE EMBODIMENTS OF THE SUBJECT OF THE PRESENT DISCLOSURE

At the basis of this disclosure is the acquisition of knowledge by the inventors of the fact that, both the appearance of preliminary sparks that cause ionization of the air, and the actual arc, are phenomena that due to their non-linear nature cause the generation of harmonic components with frequencies higher than the fundamental harmonic frequency.

According to a first embodiment of this disclosure, the above-mentioned requirements were met thanks to a method for managing a microwave heating device, where the microwave heating device is able to operate based on a first signal having a first fundamental harmonic frequency that is within the microwave range, wherein operation of the microwave heating device is interrupted or modified when, inside the microwave heating device, the presence of a second signal is detected, this second signal having harmonic components, with frequencies that are higher than and multiples of a fundamental harmonic frequency, which have an intensity higher than a critical reference value.

Hereinafter, when reference is made to "harmonic component" or to "harmonic components" without further specifications, it always refers to sinusoidal components of a signal that have a frequency which is a multiple of and higher than a fundamental harmonic frequency of a reference or fundamental signal. In contrast, when reference is made to the fundamental harmonic component of the signal, that is to say, that with a fundamental harmonic frequency, it will always be explicitly indicated.

In particular, in the preferred embodiments, what is monitored, in order to decide whether or not to interrupt or modify operation of the microwave heating device, is a second signal that propagates in the supply circuit according to a reflected direction of propagation that goes towards the signal generator of the microwave heating device, and/or a second signal that is present in the heating chamber. It should be noticed that the definition "reflected direction of propagation" is due to the fact that it is the same direction along which, in use, the power that is reflected by the heating chamber is transmitted.

Depending on the embodiments, operation of the microwave heating device is interrupted or modified when just one of the harmonic components has an intensity higher than the critical reference value, or when a group of harmonic components overall has an intensity higher than the critical reference value, or when all of the harmonic components overall have an intensity higher than the critical reference value.

In one particularly preferred embodiment, the method for managing the microwave heating device is intended to be used in a microwave heating device that itself comprises a heating chamber, a solid-state signal generator able to generate sinusoidal signals with a fundamental harmonic frequency within the microwave range, and one or more radiating portions positioned in the heating chamber and supplied by the signal generator by means of a supply circuit, for radiating microwaves in the heating chamber. The signal generator and the supply circuit can be set according to multiple operating configurations. Each operating configuration has its own fundamental harmonic frequency as well as further operating parameters such as the intensities of the signal radiated by the radiating portions and any phase differences between the signals radiated by the various radiating portions.

As in the prior art, the radiating portions may be made in any way, and for example they may be constituted of waveguide antennae, dipole antennae or patch antennae.

In this embodiment, the method comprises the following operating steps:

a setting step in which the signal generator and the supply circuit are set according to a first operating configuration having a first fundamental harmonic frequency; and a supply step in which the signal generator generates a first signal that has the first fundamental harmonic frequency as the fundamental frequency, and that is transmitted by means of the supply circuit to the one or more radiating portions according to a forward direction of propagation, that is to say, from the signal generator to the one or more radiating portions; during this step, the signal generator and the supply circuit are configured according to the first configuration.

Moreover, according to this embodiment, during the supply step the method comprises the following further operating steps:

a step of monitoring a second signal that propagates in the supply circuit according to a reflected direction of propagation that goes from the one or more radiating portions to the signal generator, and/or that is generated in the heating chamber;

a step of detecting the intensity of one or more harmonic components of the signal that is representative of the monitored second signal, where such harmonic components have a frequency higher than the fundamental harmonic frequency; and a step of comparing the intensity detected with a critical reference value.

The signal that is representative of the second signal used in the detecting step may be the entire second signal, or a predetermined part of it that in turn may be constituted of a signal proportional to the second signal or of a signal which comprises or which is proportional to, only some harmonic components of the second signal (which may or may not comprise the fundamental harmonic component). Hereinafter, any reference to detection of the second signal or of its harmonic components must therefore be understood to include all of these possibilities.

Finally, if the comparison step indicates that the intensity detected is higher than the critical reference value, the method comprises a safety intervention step in which the supply step is interrupted or in which the operating configuration used in the supply step is changed.

If the supply circuit comprises a plurality of independent branches, each of which comprises a power amplifier connected to one or more radiating portions, in some embodiments of the method the detecting step is performed at each branch with reference to the intensity (of one or more harmonic components different from the fundamental one, according to what is described above) of only the second signal affecting the branch.

In some preferred embodiments, the critical reference value is equal to 5-10 times (that is to say 7-10 dB of difference in intensity) the intensity of the corresponding harmonic components of a third signal that propagates in the supply circuit according to the reflected direction of propagation and/or that is generated in the heating chamber in a reference operating condition. In particular, the third signal is advantageously that which can be monitored in an operating condition in which there is the certainty that in the entire microwave heating device there are no electric arcs or conditions preliminary to the generation of arcs (such as localized ionizations of an air gap between two metal parts) occurring. In fact, in that case, the third signal corresponds to the system background noise due to the natural non-linearity of the power amplifiers.

Depending on the embodiments, alternatively it may also be the case that:

the detecting step comprises detection of the intensity of only one harmonic component, and in particular of the second harmonic component;

the detecting step comprises detection of the overall intensity of a group of harmonic components having a frequency higher than the fundamental harmonic frequency, preferably comprising the second harmonic component; or the detecting step comprises detection of the overall intensity of all of the harmonic components having a frequency higher than the fundamental harmonic frequency.

As already indicated, the microwave heating device disclosed comprises a heating chamber, a solid-state signal generator able to generate sinusoidal signals with a fundamental harmonic frequency within the microwave range, and one or more radiating portions positioned in the heating chamber and supplied by the signal generator by means of a supply circuit, for, in use, radiating microwaves in the heating chamber. The supply circuit also comprises at least one power amplifier connected downstream of the signal generator. Furthermore, the microwave heating device comprises an electronic control unit connected to the signal generator and to the supply circuit, for controlling their activation and setting them according to multiple operating configurations. Each operating configuration has its own fundamental harmonic frequency and in use causes the generation of microwaves in the heating chamber according to a different pattern (see the relevant information above).

At least one monitoring circuit is associated respectively with the supply circuit and/or with the heating chamber, for in use monitoring a second signal that respectively propagates in the supply circuit according to a reflected direction of propagation that goes from the one or more radiating portions to the signal generator, and/or that is generated in the heating chamber. In particular, the second signal of interest is a signal that comprises harmonic components with frequencies that are multiples (equal to two times or more) of the fundamental harmonic frequency. At least one detecting circuit is associated with the monitoring circuit for in use detecting the intensity of one or more of those harmonic components that have a frequency higher than the fundamental harmonic frequency (as already indicated, the detection may apply to the entire harmonic components or a predetermined part of them). Finally, at least one trigger circuit is associated with the detecting circuit for comparing the intensity gradually detected with a critical reference value. The trigger circuit is connected to the electronic control unit for signaling to the electronic control unit when the intensity detected is higher than the critical reference value.

In turn, the electronic control unit is programmed to act on the signal generator and/or on the supply circuit to interrupt their operation or to change the operating configuration, every time the trigger circuit signals to it that the intensity detected (that is to say, the intensity of one or more of the harmonic components which have a frequency higher than the fundamental frequency) is higher than the critical reference value.

Depending on the embodiments, the monitoring circuit and/or the detecting circuit may be made in such a way as to monitor the intensity of just one harmonic component which has a frequency higher than the fundamental frequency, in particular of the second harmonic component, or of a group of harmonic components which have a frequency higher than the fundamental frequency (in this case too, the group preferably includes the second harmonic component), or of all of the harmonic components which have a frequency higher than the fundamental harmonic frequency.

For that purpose, the monitoring circuit is preferably selected or made in such a way that it is as optimized as possible for the harmonic components which have a frequency higher than the fundamental one. However, this does not always allow sufficient attenuation of the fundamental component to be guaranteed. Consequently, at least one of either the monitoring circuit or the detecting circuit may also comprise at least one high-pass filter or one or more band-pass filters. All of those filters must be able to eliminate at least the fundamental harmonic component. In the case of band-pass filters, they will advantageously be selected in such a way that the respective band is centered on the frequency of the harmonic component, or harmonic components, of interest.

In the embodiments in which the monitoring circuit is associated with the supply circuit, the monitoring circuit may comprise a directional coupler mounted on the supply circuit. That directional coupler may be positioned near the radiating portion (preferably directly connected to it) if the aim is to monitor mainly second signals that are generated in the heating chamber and that are picked up by the radiating portion (which during use acts without distinction as a transmitting antenna or as a receiving antenna), or near the power amplifier (preferably directly connected to it) if the aim is to monitor mainly second signals that are generated at the various connections of the supply circuit.

In the embodiments in which the monitoring circuit is associated with the heating chamber, the monitoring circuit comprises a coupler with antenna positioned in the heating chamber or on a wall of it.

It may also be the case that the directional coupler is a capacitive coupler.

Moreover, advantageously, the coupler (whether directional or with antenna, and capacitive or not) may be tuned either to all of the harmonic frequencies different from the fundamental harmonic frequency, or to one or more of them depending on requirements, that is to say, depending on which harmonic components must be taken into consideration during the step of assessing the intensity.

BRIEF DESCRIPTION OF THE DRAWINGS

Further features and the advantages of this disclosure are more apparent in the detailed description below, with reference to a preferred, non-limiting embodiment of a microwave heating device, illustrated in the accompanying drawings, in which.

DETAILED DESCRIPTION OF EXAMPLE EMBODIMENTS

Below is a description first of the microwave heating device that forms the subject matter of this disclosure, and then the management method that, although not solely intended for this device, is advantageously implemented in operation of the device.

With reference to the above-mentioned figures, the microwave heating device according to this disclosure was labelled with the numeral 1 in its entirety.

Figure 1:
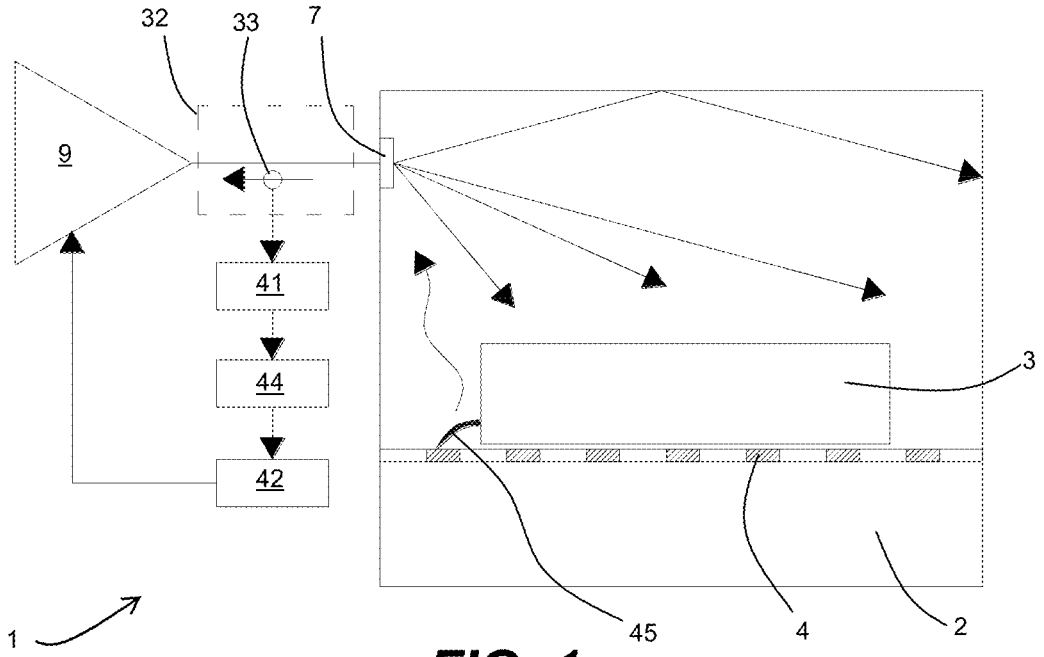
FIG. 1 is a schematic view of the overall layout of the microwave heating device, showing several of the most important elements.

As visible in FIG. 1, the microwave heating device 1 comprises first a heating chamber 2 in which a product 3 can be positioned (such as a food product 3 to be cooked, heated or defrosted), if necessary positioned on a suitable tray, even made of metal. In the chamber 2 there may be one or more supporting grids 4 for the product 3. Those supporting grids 4 may be made of metal material.

The microwave heating device 1 also comprises a signal generator 5 that by means of a supply circuit 6 is connected to one or more radiating portions 7 positioned in the heating chamber 2 or in waveguides in turn connected to the heating chamber (embodiment not illustrated). The supply circuit 6 comprises at least one power amplifier 8 connected downstream of the signal generator 5. In use, the one or more radiating portions 7 are supplied by the signal generator 5 by means of the supply circuit 6 for radiating microwaves in the heating chamber 2. In FIG. 1, the signal generator 5 and the supply circuit 6 are schematically illustrated with a single triangle 9.

Figure 2:
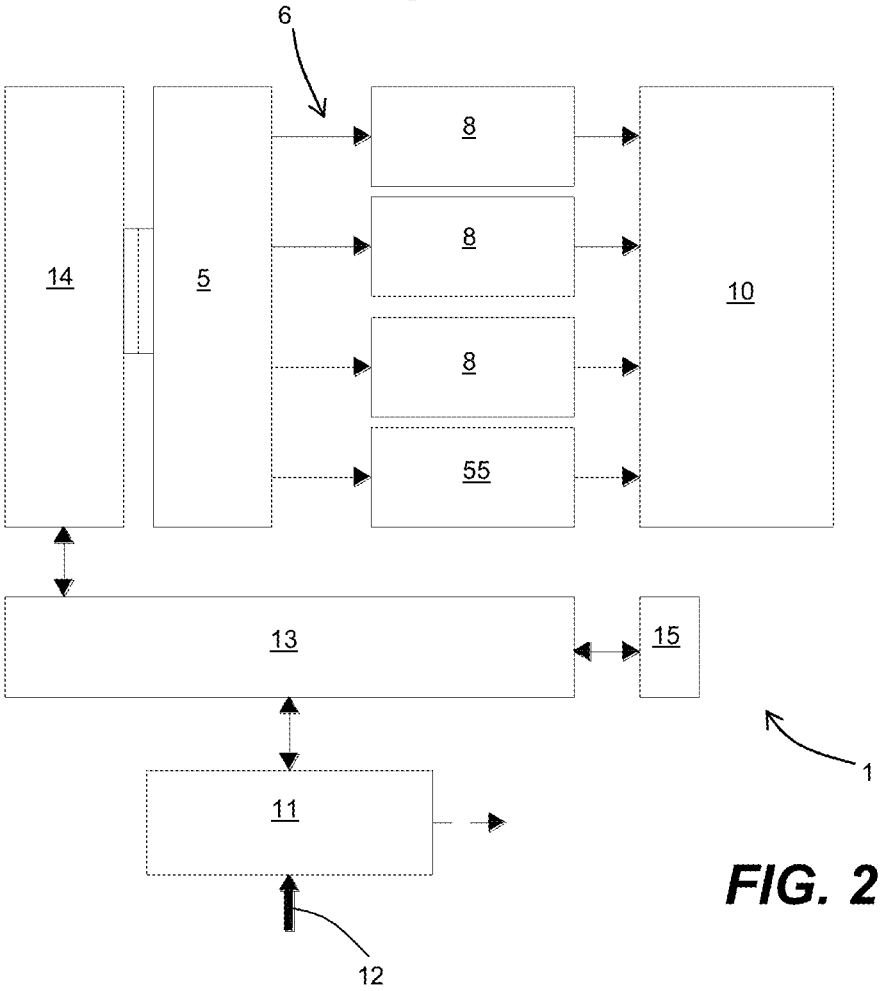
FIG. 2 is a block diagram of the power and control electronics of the microwave heating device.

FIG. 2 shows a more detailed block diagram of all of the main electric and electronic components of a microwave heating device 1 according to this disclosure. In this figure, for simplicity, all of the radiating portions 7 and the heating chamber 2 are schematically illustrated with a single block 10 in which the power signals coming out of the power amplifiers 8 meet.

Therefore, generally speaking, as can be seen, the microwave heating device 1 comprises first a supply interface 11 that in use is connected to the electric mains network 12 from which it receives the energy needed in order to operate. The supply interface 11 may comprise various sections characterized by different electric output parameters (voltage and current), intended to supply all of the different elements of the heating device 1 that require an electricity supply.

A control interface 13 in use allows the user to control operation of the heating device 1. The control interface 13 is connected both to a control board 14 of the microwave heating device 1, and to any sensors or detectors 15 associated with the heating chamber 2. Whilst in the embodiment illustrated the control board 14 is separate from the signal generator 5 (to which it is only connected), in other embodiments both the control board 14 and the signal generator 5 may be integrated in a single board that performs the functions of both.

Figure 4:
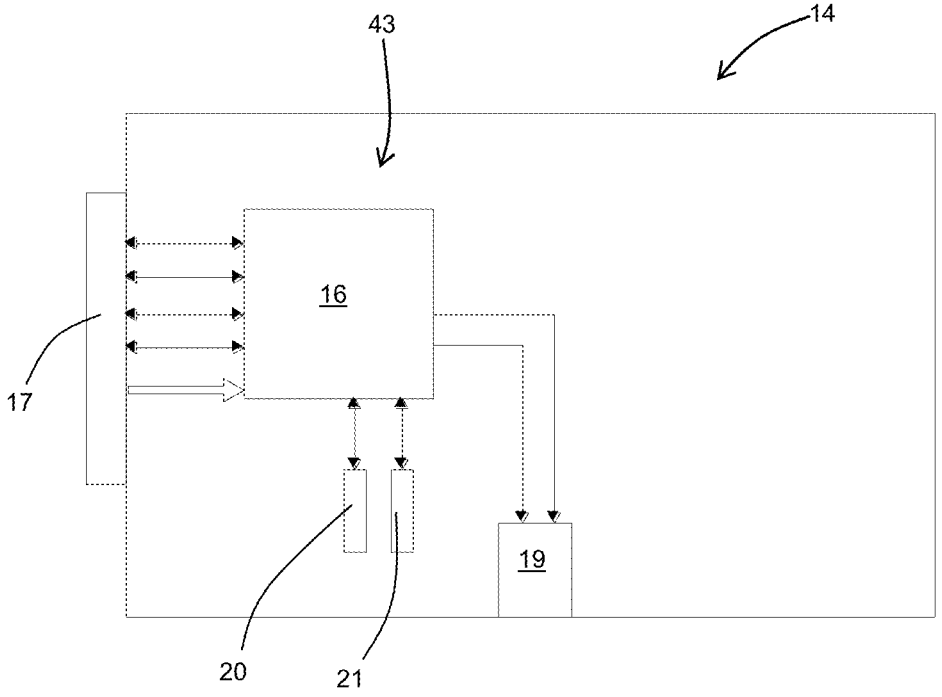
FIG. 4 is a more detailed schematic view of several components of the electronic control board of FIG. 3.

The control board 14 illustrated in FIG. 4 advantageously comprises a processing integrated circuit 16, which may be a microprocessor, a FPGA (currently the preferred choice as regards the processing speed), etc. and which is connected to a first DIN connector 17, to an RJ45 interface 19, and to two memory cards 20, 21 one Flash and the other DDRAM. The first DIN connector 17, in addition to a plurality of power supply voltages, carries at least four different types of signal (SPI; UART, GPIO I2C)

Figure 3:
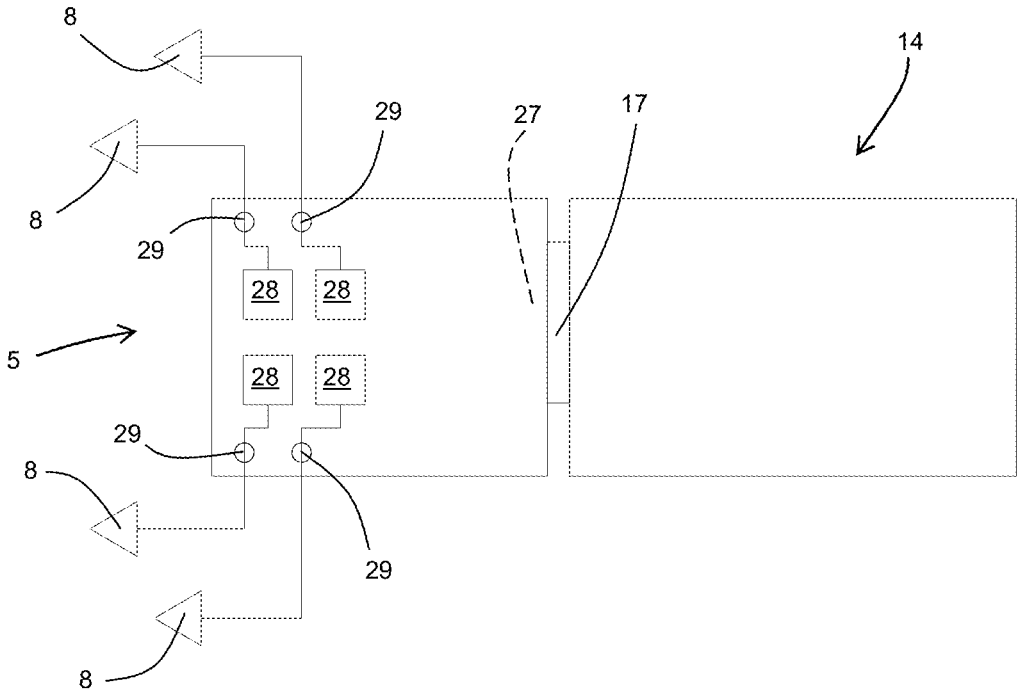
FIG. 3 is a schematic view of a signal generator, a control board and several power amplifiers of the microwave heating device.

As illustrated in FIG. 3, the first DIN connector 17 rigidly connects the control board 14 to the signal generator 5 (equipped with a second DIN connector 27 specular to the first 17), which is of the solid-state type and can generate sinusoidal (voltage) signals with a fundamental harmonic frequency within the microwave range, that is to say, within the range from 300 MHz to 300 GHz. However, preferably, the fundamental harmonic frequency of the sinusoidal signal lies within one of the ranges of the international standards for microwave heating, that is to say, ISM ranges: 433.050-434.790 MHz, 902.000-928.000 MHz, 2.400-2.500 GHz, 5.725-5.875 GHz, 24.000-24.250 GHz, 61.000-61.500 GHz, 122.000-123.000 GHz, 244.000-246.000 GHz.

Depending on requirements, the signal generator 5 may be configured to generate either just one, or more, sinusoidal signals, each of which is then sent, by means of the supply circuit 6, to one or more power amplifiers 8. In the case illustrated in FIG. 2, in particular, the signal generator 5 is able to generate four first signals that are sent (preferably with predetermined phase differences from each other) to four power amplifiers 8 (it shall be understood that what is described here and below with reference to the four signals of the case illustrated, is scalable to any number of such signals).

For that purpose, as is schematically illustrated in FIG. 3 which shows the generating part of the signal generator 5, the signal generator 5 comprises four generating circuits 28, preferably identical to each other, that are controlled by the control board 14 and that in use generate four signals that are identical in frequency and intensity (low), with a suitable phase difference from one another, or in phase with each other, depending on requirements. Those signals are made available at specific signal connectors 29. To guarantee optimum control of the relative phases of the four signals, one of the four generating circuits 28 is used as the master and supplies a master oscillation to the other three which are connected to it in series and which therefore operate as slaves. In fact, the master oscillation defines both an absolute phase reference for the others, and the system frequency.

Therefore, in general, an electronic control unit 43 is connected to the signal generator 5 and to the supply circuit 6 for controlling their activation and setting them according to multiple operating configurations. As already indicated, each operating configuration has its own fundamental harmonic frequency and in use causes the generation of microwaves in the heating chamber 2. In particular, the electronic control unit 43 acts on the signal generator 5 in such a way that the latter generates one or more first signals that propagate towards the one or more power amplifiers 8 of the supply circuit 6 with suitable phase differences from each other. In the embodiment illustrated in the accompanying figures, the function of the electronic control unit 43 is performed by the processing integrated circuit 16 of the control board 14.

The device 1 also comprises at least one monitoring circuit 32 associated respectively with the supply circuit 6 (as illustrated in FIG. 1) and/or with the heating chamber 2 (solution not illustrated). In the former case, the monitoring circuit 32 is designed in use to monitor a second signal that propagates in the supply circuit 6 according to a reflected direction of propagation, that is to say, a direction of propagation that goes from the one or more radiating portions 7 towards the signal generator 5. In the latter case, the monitoring circuit 32 is designed to monitor a second signal that is generated in the heating chamber 2.

As already indicated, in the preferred embodiments, the monitoring circuit 32 comprises a coupler 33 which, if applied to the supply circuit 6, is advantageously of the directional type so that it is able to monitor exclusively the signal that propagates according to the reflected direction of propagation.

Moreover, in general, at least one detecting circuit 41 is associated with the monitoring circuit 32 for in use detecting the intensity of one or more harmonic components of said second signal, which have a frequency higher than the fundamental harmonic frequency. In several embodiments the control board 14, more precisely its processing integrated circuit 16, may even directly act as the detecting circuit 41.

Furthermore, at least one trigger circuit 42 is associated with the detecting circuit 41 for comparing the intensity detected (that of one or more harmonic components which have a frequency higher than the fundamental harmonic frequency) with a critical reference value. In general, the trigger circuit 42 is connected to the electronic control unit 43 for signaling to it when the intensity detected is higher than the critical reference value. In some embodiments, the control board 14, and more precisely its processing integrated circuit 16, may also perform the functions of the trigger circuit 42. In contrast, in the case schematically illustrated in FIG. 1, both the detecting circuit 41 and the trigger circuit 42 are independent of the processing integrated circuit 16. However, the trigger circuit 42 is connected to the processing integrated circuit 16 (that is to say, to the electronic control unit 43) for sending the latter a signal every time it ascertains that the intensity detected is higher than the critical reference value.

The monitoring circuit 32, the detecting circuit 41 and the trigger circuit 42 are not described in detail herein, since they are in themselves conceptually known and within the reach of experts in the field.

In turn, the electronic control unit 43 is programmed to act on the signal generator 5 and/or on the supply circuit 6 to interrupt their operation or to change the operating configuration when the trigger circuit 42 signals to it that the intensity detected is higher than the critical reference value.

As already indicated, at least one of either the monitoring circuit 32 or the detecting circuit 41 also comprises at least one high-pass filter or one or more band-pass filters (generically identified with the block 44 in FIG. 1) able to eliminate a fundamental harmonic component, that is to say, the harmonic component whose frequency corresponds to the fundamental harmonic frequency (however, it should be noticed that a first attenuation of this fundamental harmonic component may also be caused by the coupler 33 of the monitoring circuit 32 which may appropriately be tuned only to the frequencies of the harmonic components of interest).

Operation of the heating device 1 disclosed is similar to that of the prior art devices during operation without any type of electric discharges. The signal generator 5 generates the various signals with low intensity, transmits them to the one or more power amplifiers 8 which bring their power to the required level and then transmit the power signals to the radiating portions 7.

In contrast, when either in the heating chamber 2 or in any other part of the supply circuit 6 an electric discharge 45 occurs, the harmonic components different from the fundamental one that propagates according to the reflected direction, are subjected to a sudden increase in intensity (in particular the second harmonic component), such that it can be identified by the trigger circuit 42 which can therefore warn the electronic control unit 43. The latter can then act on the operating configuration and prevent the discharge 45 from continuing. It should also be noticed that, in many operating conditions, an increase in the intensity of the harmonic components different from the fundamental one to the extent that it can be identified by the trigger circuit 42 may be caused by an actual electric arc or by transitory sparks which may occur during the process of ionization of the discharge channel 45. In the latter case, the electronic control unit 43 is able to act even before the actual arc begins.

As already indicated, operation of the microwave heating device 1 according to this disclosure constitutes a particular case of implementation of the management method disclosed, which will be described in more detail below.

In a more general form of it, the method disclosed is usable for managing any microwave heating device 1 that can operate based on a first signal having a first fundamental harmonic frequency within the microwave range. The first signal is that which, suitably amplified and if necessary divided into two or more signals with appropriate phase differences, is radiated in the heating chamber 2.

In fact, the method comprises monitoring the presence in the heating device 1 of one or more second signals which have harmonic components with frequencies that are multiples of the first fundamental harmonic frequency (and higher than it), and checking whether such harmonic components have, jointly or individually, an intensity higher than a critical reference value. When that occurs, the method comprises interruption of operation of the microwave heating device 1 or modification of the operating parameters, if possible, to prevent an electric arc from being generated, or at least to interrupt it if it has already been generated.

In particular, the method comprises monitoring a second signal that propagates in the supply circuit 6 according to a reflected direction of propagation, that is to say, a direction of propagation that goes towards a signal generator 5 of the microwave heating device 1 (for example, in the case of propagation along the supply circuit 6), or a second signal that is in any case present in the heating chamber 2.

Depending on the embodiments, the intensity monitored and compared with the critical reference value may be that of just one of the harmonic components after the fundamental one (advantageously the second), or that of a group of harmonic components after the fundamental one (for example, between the second and the fifth, inclusive), or that of all of the harmonic components after the fundamental one.

In a more specific embodiment of it, which is also reflected in the operation of the microwave heating device 1 described above, the method disclosed is applicable to a microwave heating device 1 that comprises a heating chamber 2, a solid-state signal generator 5 able to generate sinusoidal signals with a fundamental harmonic frequency within the microwave range, and one or more radiating portions 7 positioned in the heating chamber 2 and supplied by the signal generator 5 by means of a supply circuit 6, for in use radiating microwaves in the heating chamber 2. Moreover, the signal generator 5 and the supply circuit 6 can be set according to multiple operating configurations, each operating configuration having its own fundamental harmonic frequency within the microwave range.

In this embodiment, the method comprises first a setting step in which the signal generator 5 and the supply circuit 6 are set according to a first operating configuration which has its own first fundamental harmonic frequency.

Then comes a supply step in which the signal generator 5 generates a first signal with the first fundamental harmonic frequency. The first signal is transmitted by means of the supply circuit 6, and in accordance with the first operating configuration (that is to say, with predetermined intensity and phase values—the latter if there are two or more radiating portions 7), to the one or more radiating portions 7 according to a forward direction of propagation that goes from the signal generator 5 to the one or more radiating portions 7. The radiating portions 7 supplied in this way cause the microwaves to be radiated in the heating chamber 2. In FIG. 1 the arrows extending straight schematically illustrate several of the infinite directions of propagation/reflection of the microwaves in the heating chamber 2.

During the supply step, the method also comprises the execution of further steps with the aim of preventing or interrupting any electric arcs. In particular, it comprises first a step of monitoring a second signal that propagates in the supply circuit 6 according to a reflected direction of propagation (that is to say, that goes from the one or more radiating portions 7 to the signal generator 5), and/or that is generated in the heating chamber 2. The second signal of interest is a signal that has harmonic components after the fundamental harmonic component (that is to say, that with a frequency equal to the frequency of the first signal). To effectively monitor that second signal, it is possible either to monitor the entire signal that either propagates along the reflected direction or is present in the heating chamber 2, or to selectively monitor only the harmonic components of interest of that second signal (for example, see what is described above concerning the use of couplers 33 tuned to specific frequencies, if necessary in combination with high-pass or band-pass filters) or only part of the entire signal or of the harmonic components of interest. In FIG. 1, the undulating arrow schematically illustrates the second signal generated by the electric discharge 45 (whether this is an actual permanent arc or an isolated spark) that radiates in the heating chamber 2 (in the form of an electromagnetic field) and towards the radiating portion through which it may further radiate in the supply circuit 6 (in the form of electric voltage).

Then there is a step of detecting the intensity of said one or more harmonic components of interest (which have a frequency higher than the fundamental harmonic frequency), and a step of comparing the intensity detected in that way with a critical reference value.

Finally, every time the comparison step indicates that the intensity detected is higher than the critical reference value, there is a safety intervention step in which the supply step is interrupted or in which the operating configuration is changed.

When the supply circuit 6 comprises a plurality of independent branches, each of which is equipped with a power amplifier 8 connected to one or more radiating portions 7, in the method the detecting step may be performed at each branch with reference to the intensity of only the second signal affecting the branch.

The critical reference value to be used in the detecting step must be set in such a way that it is sufficiently but not excessively higher than the intensity detectable with reference to the system background noise (at the harmonic frequencies of interest), so as to simultaneously avoid the risk of false detections of a discharge 45 and to keep the sensitivity of the system as high as possible. In general, the intensity of the system background noise monitored in normal operating conditions depends both on the natural non-linearity of the power amplifiers 8, and on the imperfect filtering of only the harmonic components of interest. Therefore, for practical applications, the intensity of the background noise, at the harmonic frequencies of interest, may conventionally be selected as equal to the detectable intensity of a third signal that propagates in the supply circuit 6 according to the reflected direction of propagation and/or that is generated in the heating chamber 2 in a reference operating condition of the microwave heating device 1. Preferably, that reference operating condition involves the device 1 operating at maximum power.

The critical reference value is therefore preferably selected as equal to 5-10 times the value of the background noise (that is to say, with a 7-10 dB margin relative to the background noise).

As is evident from the above description, this disclosure brings important advantages.

In fact, thanks to what is provided, it is possible to prevent the formation of electric arcs in the microwave heating device 1 or at least, at worst, to minimize their duration.

Finally, it should be noticed that this disclosure is relatively easy to produce and that even the cost linked to its implementation is not very high.

The disclosure described above may be modified and adapted in several ways without thereby departing from the scope of the inventive concept.

All details may be substituted with other technically equivalent elements and the materials used, as well as the shapes and dimensions of the various components, may vary according to requirements.

The invention claimed is:

1. A method for managing a microwave heating device wherein the microwave heating device comprises:

a heating chamber;

a signal generator, the signal generator being of the solid-state type and being able to generate sinusoidal signals with a fundamental harmonic frequency within the microwave range;

one or more radiating portions positioned in the heating chamber and supplied by the signal generator via a supply circuit, for radiating microwaves in the heating chamber;

the signal generator and the supply circuit being settable according to multiple operating configurations, each operating configuration having its own fundamental harmonic frequency; the method comprising:

a setting step in which the signal generator and the supply circuit are set according to a first operating configuration having a first fundamental harmonic frequency; and a supply step in which the signal generator generates a first signal with the first fundamental harmonic frequency, which is transmitted by means of the supply circuit, and, according to the first operating configuration, to the one or more radiating portions according to a forward direction of propagation that goes from the signal generator to the one or more radiating portions;

and wherein, during the supply step, the method also comprises:

a step of monitoring a second signal that propagates in the supply circuit according to a reflected direction of propagation that goes from the one or more radiating portions to the signal generator, and/or that is generated in the heating chamber;

a step of detecting the intensity of one or more harmonic components of said second signal, which have a frequency higher than the fundamental harmonic frequency;

a step of comparing the intensity detected with a critical reference value;

and, when the comparison step indicates that the intensity detected is higher than the critical reference value, a safety intervention step in which the supply step is interrupted or in which the operating configuration is changed.

2. The method according to claim 1, wherein the supply circuit comprises a plurality of independent branches, each of which comprises a power amplifier connected to one or more radiating portions, wherein according to the method the monitoring and detecting steps are performed at each branch with reference to the intensity of only the second signal affecting the branch.

3. The method according to claim 1, wherein the critical reference value is equal to 5-10 times the intensity of a third signal that propagates in the supply circuit according to the reflected direction of propagation and/or that is generated in the heating chamber in a reference operating condition.

4. The method according to claim 1, wherein the monitoring step and/or the detecting step are carried out with reference to a signal proportional to the second signal or to one or more harmonic components of the second signal.

5. The method according to claim 1, wherein alternatively:

the detecting step comprises detection of the intensity of only a second harmonic component;

the detecting step comprises detection of the overall intensity of a group of harmonic components having a frequency higher than the fundamental harmonic frequency; or the detecting step comprises detection of the overall intensity of all of the harmonic components having a frequency higher than the fundamental harmonic frequency.

* * * * *